US008033622B2

(12) United States Patent
Oh et al.

(10) Patent No.: US 8,033,622 B2
(45) Date of Patent: Oct. 11, 2011

(54) REFRIGERATOR

(75) Inventors: Seung Hwan Oh, Gunpo-si (KR); Kyung Han Jeong, Seoul (KR); Sang Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 26 days.

(21) Appl. No.: 12/400,615

(22) Filed: Mar. 9, 2009

(65) Prior Publication Data

US 2009/0167131 A1 Jul. 2, 2009

Related U.S. Application Data

(62) Division of application No. 11/256,989, filed on Oct. 25, 2005, now abandoned.

(30) Foreign Application Priority Data

Oct. 26, 2004 (KR) ..... 10-2004-0085689
Nov. 15, 2004 (KR) ..... 10-2004-0093111

(51) Int. Cl.
*A47B 96/04* (2006.01)
*A47B 88/00* (2006.01)

(52) U.S. Cl. ..... 312/402; 312/330.1; 312/223.6

(58) Field of Classification Search ..... 312/402, 312/404, 405, 223.6, 330.1; 174/69; 242/611, 242/611.1, 587.2, 587.3, 388.1, 393, 388.5, 242/370, 371

See application file for complete search history.

(56) References Cited

U.S. PATENT DOCUMENTS

| | | | | |
|---|---|---|---|---|
| 1,067,404 | A | 7/1913 | Callaghan | |
| 1,902,795 | A | 3/1933 | Wolters | |
| 2,420,772 | A * | 5/1947 | Dalton | 343/720 |
| 2,656,991 | A | 10/1953 | Neely | |
| 3,028,209 | A | 4/1962 | Hinkel et al. | |
| 3,782,654 | A | 1/1974 | Kasa | |
| 3,792,189 | A * | 2/1974 | Stengel et al. | 174/69 |
| 4,245,873 | A * | 1/1981 | Markowitz | 439/32 |
| 4,901,938 | A * | 2/1990 | Cantley et al. | 242/378.1 |
| 5,041,002 | A * | 8/1991 | Byrne | 439/215 |
| 5,304,993 | A * | 4/1994 | Handsaker | 340/984 |
| 5,453,585 | A * | 9/1995 | Lenz et al. | 191/12.2 R |
| 5,701,981 | A * | 12/1997 | Marshall et al. | 191/12.4 |
| 5,895,275 | A * | 4/1999 | Harbertson | 439/21 |
| 6,065,708 | A | 5/2000 | Matsubara | |
| 6,077,086 | A * | 6/2000 | LaRoche | 439/32 |
| 6,416,022 | B1 * | 7/2002 | Crespi | 248/49 |
| 6,421,044 | B2 * | 7/2002 | Murphy | 345/163 |
| 6,641,239 | B2 | 11/2003 | Kaiser | |
| 6,793,259 | B2 * | 9/2004 | Sano et al. | 296/155 |
| 6,858,951 | B2 | 2/2005 | Liao | |
| 7,183,502 | B1 * | 2/2007 | Johnston et al. | 174/480 |
| 2005/0073225 | A1 | 4/2005 | Kwon et al. | |

FOREIGN PATENT DOCUMENTS

CN 1106527 A 8/1995

(Continued)

*Primary Examiner* — Darnell Jayne
*Assistant Examiner* — Timothy M Ayres
(74) *Attorney, Agent, or Firm* — Birch, Stewart, Kolasch & Birch, LLP

(57) ABSTRACT

A refrigerator includes a body having a compartment in the body and a door for opening and closing the compartment, an electrical device movable with respect to the body along a first direction, a conductor electrically connecting the electrical device with the body, and a winding device to apply a tension to the conductor in the first direction toward the compartment.

15 Claims, 10 Drawing Sheets

FOREIGN PATENT DOCUMENTS

| | | | |
|---|---|---|---|
| CN | 2247784 | Y | 2/1997 |
| JP | 05-296647 | A | 11/1993 |
| JP | 2002-243354 | A | 8/2002 |
| JP | 10-2003-0079552 | A | 10/2003 |
| KR | 20-1998-013821 | | 6/1998 |
| KR | 1998-026269 | A | 7/1998 |
| KR | 2003-050084 | A | 2/2003 |
| KR | 10-2003-0088557 | A | 11/2003 |

* cited by examiner

REFRIGERATOR

This application is a Divisional of application Ser. No. 11/256,989 filed on Oct. 25, 2005, now abandoned and for which priority is claimed under 35 U.S.C. §120; and this application claims priority of Patent Application No. 10-2004-0085689 filed in Korea on Oct. 26, 2004, and Patent Application No. 10-2004-0093111 filed in Korea on Nov. 15, 2004, under 35 U.S.C. §119(a); the entire contents of all are hereby incorporated by reference.

BACKGROUND OF THE INVENTION

1. Field of the Invention

The present invention relates to a refrigerator, and more particularly, to a mechanism electrically connecting a body of the refrigerator with an electrical device which is mounted on a door or a part of the refrigerator movable with respect to the body of the refrigerator.

2. Discussion of the Related Art

Conventional refrigerators are usually classified into three types, i.e., a top mount freezer type, a side by side type, and a bottom mount freezer type. In the top mount freezer type refrigerator, a freezing compartment is provided on an upper portion of the refrigerator and a refrigerating compartment is provided at a lower portion of the refrigerator. In the side by side type refrigerator, a freezing compartment and a refrigerating compartment are respectively arranged on a left portion and a right portion of a refrigerator. In the bottom mount freezer type refrigerator, a freezing compartment is provided on a lower portion of the refrigerator and a refrigerating compartment is provided on an upper portion of the refrigerator.

Electrical devices, such as a display panel, an ice and a water dispenser, etc., are usually provided on a door of a refrigerator. The electrical device is electrically connected with a body of the refrigerator by a conductor. The conductor supplies electrical power from a power source provided in the body of the refrigerator or sends a signal from a controller of the refrigerator and vice versa. The door and the body of the refrigerator are usually coupled by a hinge and the conductor is arranged to pass through the hinge in order to electrically connect the electrical device on the door and the body of the refrigerator.

Meanwhile, it is very uncomfortable for the user to use the freezing compartment mounted at the lower portion of the refrigerator when the door is simply open by rotating about the hinge, because the user has to kneel and bend his or her body and stretch his/her hands into an inside of the freezing compartment mounted on the lower portion of the refrigerator.

SUMMARY OF THE INVENTION

Accordingly, the present invention is directed to a refrigerator that substantially obviates one or more problems due to limitations and disadvantages of the related art.

An object of the present invention is to provide a refrigerator which can elevate a compartment provided at a lower portion of the refrigerator when the door is open for the user's convenience and a mechanism for electrically connecting a device for elevating the compartment with the body.

The other object of the present invention is to provide a refrigerator having a mechanism which can electrically connect a body of the refrigerator with an electrical device mounted on a door coupled with the body without a hinge or mounted on a part of the refrigerator movable with respect to the body.

Another object of the present invention is to prevent a conductor electrically connecting the electrical device with the body from being damaged by a movement of the door or other parts of the refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in one aspect of the present invention, a refrigerator includes a body having a compartment in the body and a door for opening and closing the compartment; an electrical device movable with respect to the body along a first direction; a conductor electrically connecting the electrical device with the body; and a winding device for adjusting a length of the conductor in the first direction when the electrical device moves along the first direction.

The electrical device may be movable forward or backward with respect to the body along the first direction.

The refrigerator may further include a container provided in the compartment, wherein the electrical device may include an elevating device for elevating the container.

The refrigerator may further include a first rail secured to the body, and a second rail secured to the door, wherein the first and the second rails guide a movement of the door. In this case, the conductor may be arranged to pass through the first and the second rails.

The refrigerator may further include a conductor guide extendable and retractable along the first direction when the electric part moves along the first direction, wherein the conductor may be arranged to pass through the conductor guide. The conductor guide may include a first and a second guides overlappable with each other along the first direction.

The winding device of the refrigerator may apply a tension of the conductor in the first direction toward the compartment.

The winding device of the refrigerator may automatically wind or unwind the conductor when the electrical device moves along the first direction.

In one embodiment of the present invention, the winding device may include a reel around which the conductor is wound, and an elastic member. The elastic member may apply a rotational force on the reel so that a tension is applied to the conductor in the first direction toward the compartment to tighten the conductor. The elastic member may include a spring which accumulates an elastic energy therein while the door is open.

Alternatively, the winding device may include a reel around which the conductor is wound, and a mechanism for rotating the reel to wind or unwind the conductor when the electrical device moves along the first direction. The mechanism may include a rack arranged along the first direction, and a pinion engaged with the rack and secured to the reel. The reel may extend from a lateral side of the pinion. The conductor may be arranged to pass through the reel to be wound around the reel when the reel rotates. The reel may be located at a middle portion of the conductor when the conductor extends to a maximum length in the first direction so that the reel can wind the conductor at both sides of the conductor at the same time.

The winding device may be arranged in the rails. In this case, the winding device may include a reel, around which the conductor is wound, secured to any one of the first and the second rails, a rack secured to the other one of the first and the second rails and arranged along the first direction, and a pinion engaged with the rack and secured to the reel.

Alternatively, the winding device may be arranged in the conductor guide. In this case, the winding device may include a reel secured to any one of the first and the second guides, the reel around which the conductor is wound, a rack secured to the other one of the first and the second guides and arranged along the first direction, and a pinion engaged with the rack and secured to the reel.

In the other aspect of the present invention, a refrigerator includes a body having a compartment therein and a door opening and closing the compartment; an electrical device movable with respect to the body along a first direction; a conductor electrically connecting the electrical device with the body; and a winding device for applying a tension on the conductor in the first direction toward the compartment.

In another aspect of the present invention, a refrigerator includes a body having a compartment therein and a door opening and closing the compartment; an electrical device movable with respect to the body along a first direction; a conductor electrically connecting the electrical device with the body; and means for winding and unwinding the conductor when the electrical device moves along the first direction.

The means for device winding and unwinding the conductor may include a reel which automatically rotates when the electrical device moves along the first direction to wind or unwind the conductor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
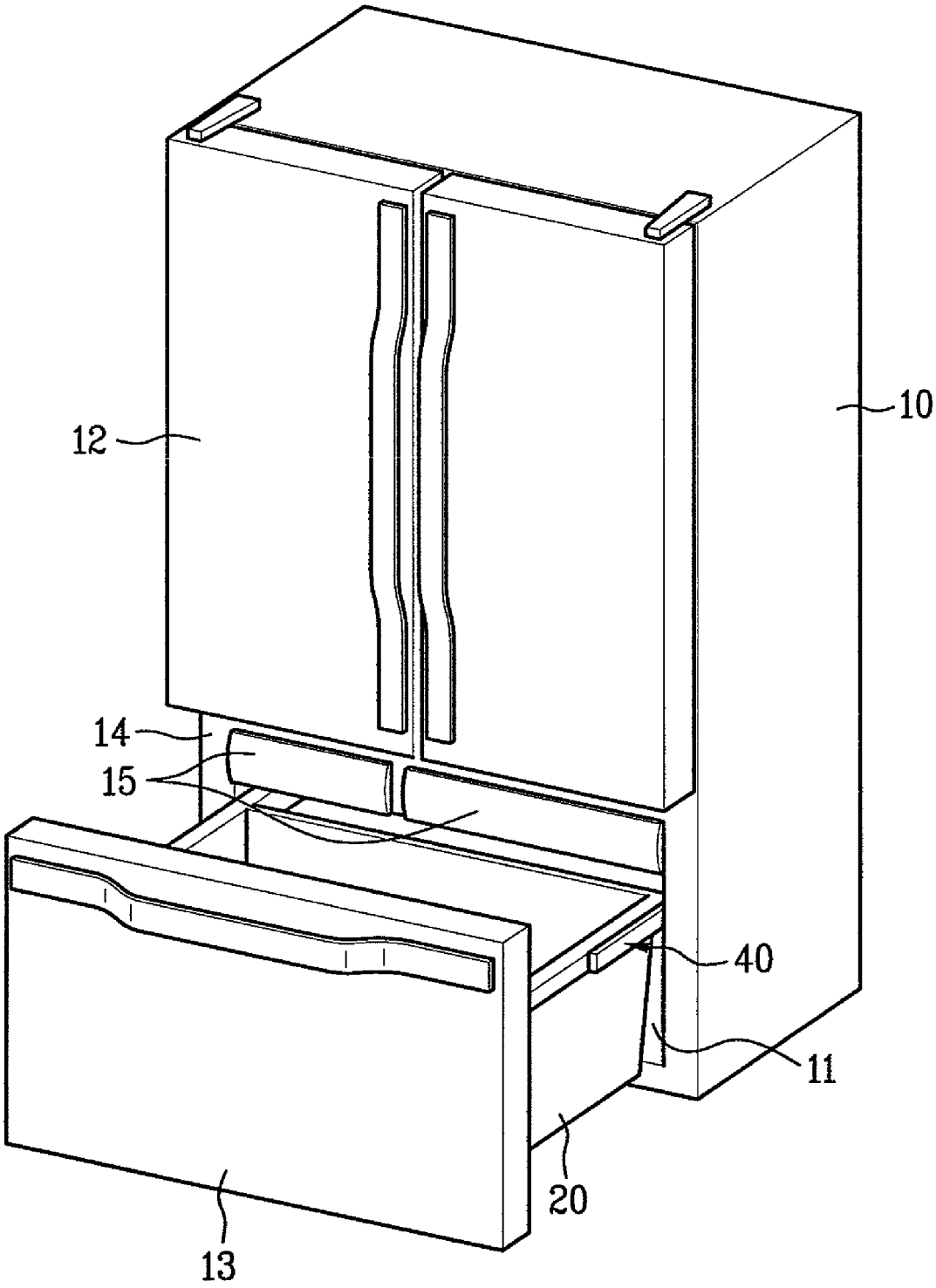
FIG. 1 illustrates a perspective view of a refrigerator according to an embodiment of the present invention.

Referring to FIG. 1, a refrigerator according to an embodiment of the present invention includes a body 10, compartments provided in the body 10, and doors 12 and 13 for opening/closing the compartments. The compartments, for example, include a refrigerating compartment (not shown) provided in an upper portion of the body 10 and a freezing compartment 11 provided in a lower portion of the body 10. Alternatively, it is possible that the refrigerating compartment is located in the lower portion of the body 10 and the freezing compartment is located in the upper portion of the body 10. A horizontal partition wall 14 divides an inside space of the body 10 into the refrigerating compartment and the freezing compartment 11. A mechanical component chamber 17 for accommodating a compressor, a condenser, etc. is provided in the lower portion of the body 10, especially at a rear of the freezing compartment 11 as shown in FIG. 2.

A pair of doors 12 is coupled to the body 10 by a hinge. The doors 12 rotate about the hinge with respect to the body 10 for opening and closing the refrigerating compartment. The door 13 is provided at the lower portion of the body 10 for opening and closing the freezing compartment 11 at the lower portion of the body 10. The door 13 moves forward and backward with respect to the body 10 and the door 12 rotates about the hinge. Therefore, no hinge or pivot is necessary for the door 13 to be coupled with the body 10.

Figure 2:
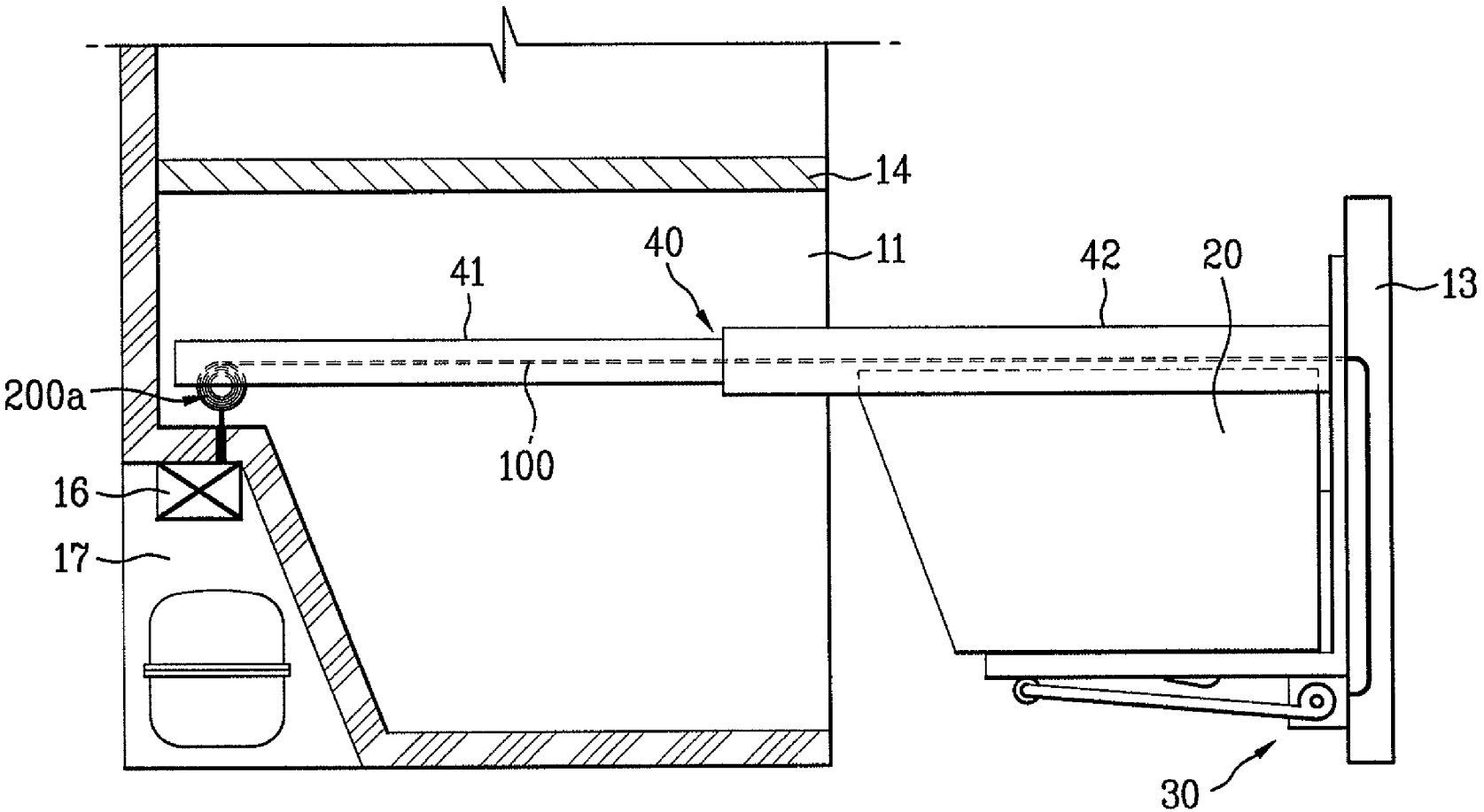
FIG. 2 illustrates a schematic cross-sectional view of a lower portion of the refrigerator in accordance with a first embodiment of the present invention when a door is open.

A plurality of rails 40 are provided between the body 10 and the door 13 for smoothly guiding a sliding movement of the door 13 as shown in FIGS. 1 and 2. The rails 40 are arranged at both sides of the door 13, and include a first rail 41 secured to the body 10 and a second rail 42 secured to a backside of the door 13. Alternatively, a bracket 25 firmly secured to the backside of the door 13 may be provided and the second rail 42 may be secured to the bracket 25.

Figure 5:
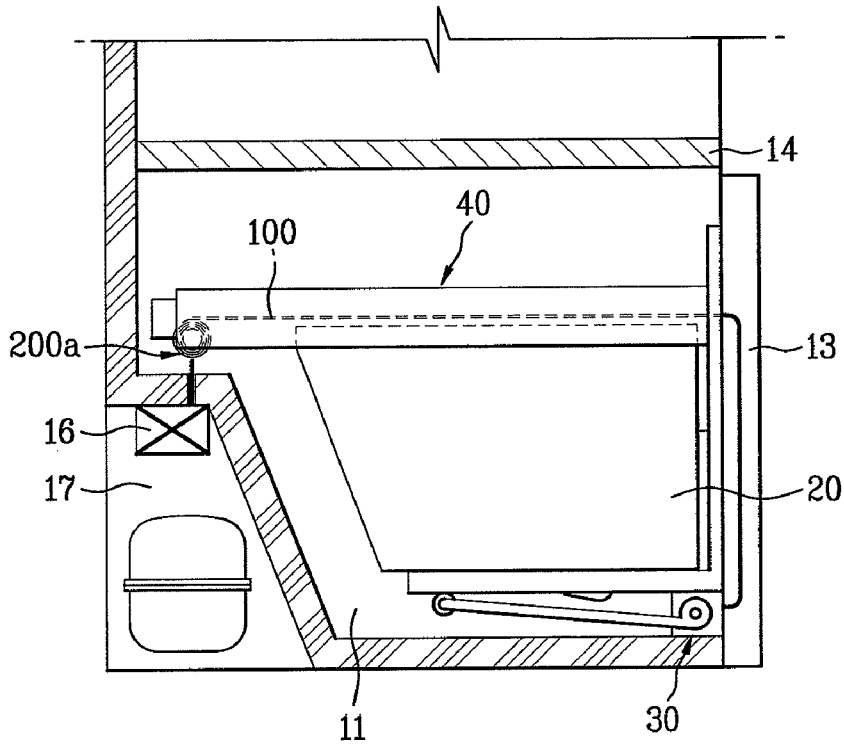
FIG. 5 illustrates a schematic cross-sectional view of the lower portion of the refrigerator in accordance with the first embodiment of the present invention when the door is closed.

The first rail 41 is able to move with respect to the second rail 42 by sliding and vice versa. For a smooth sliding of the first and the second rails 41 and 42, a plurality of balls or rollers may be provided between the first and the second rails 41 and 42. The first rail 41 may be arranged on the second rail 42 and vice versa. Alternatively, the first rail 41 may be inserted into the second rail 42 as shown in FIG. 5 and vice versa. Meanwhile, the rails 40 may include three or more than three rails connected to each other.

Figure 3:
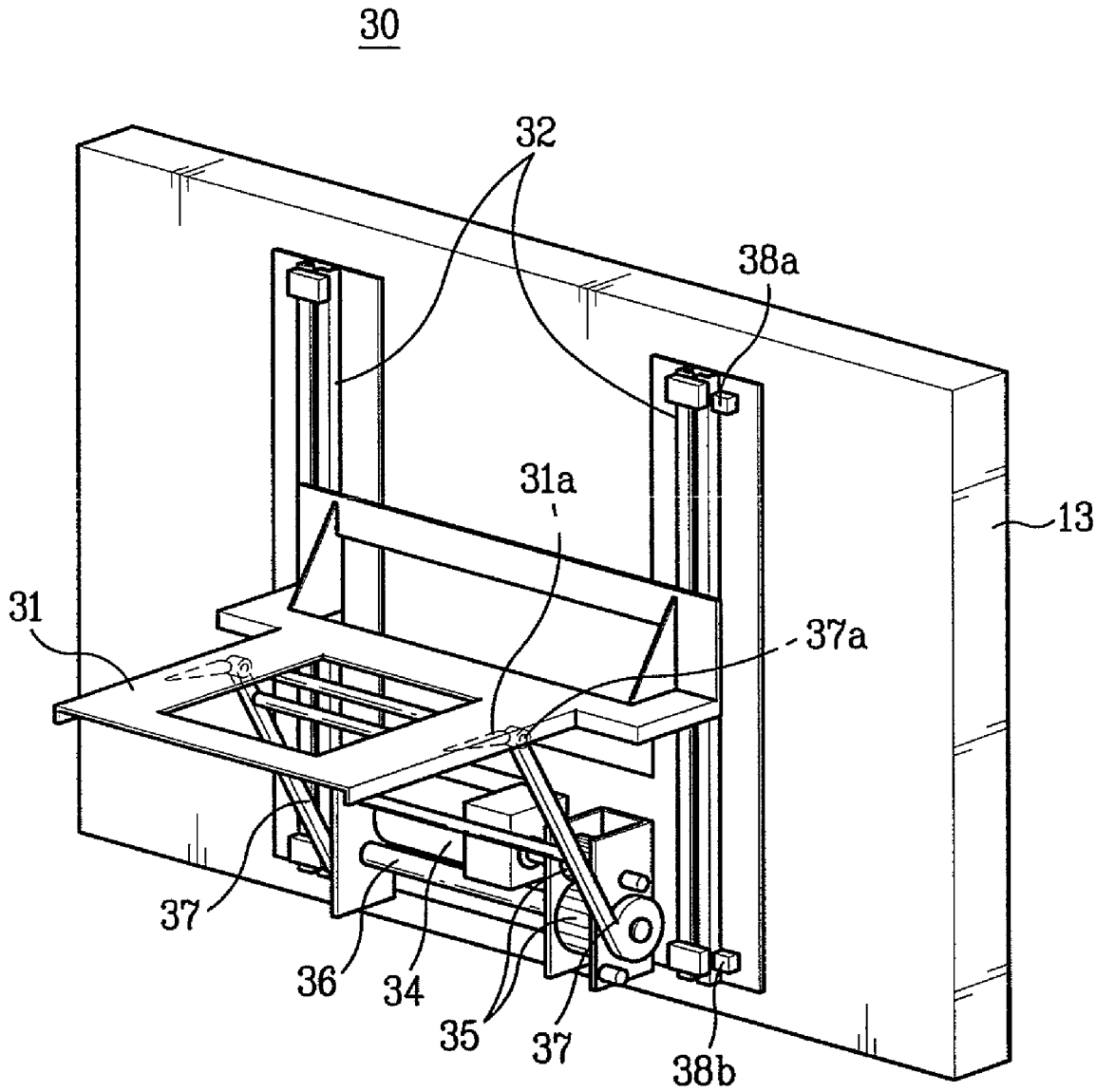
FIG. 3 illustrates a perspective view of an elevating device mounted on the door of the refrigerator shown in FIG. 1.

At least one container 20 for storing food therein is provided in the freezing compartment 11 at a lower portion of the freezing compartment 11 as shown in FIGS. 1 and 2, and at least one drawer 15 is provided above the container 20 in the freezing compartment 11 as shown in FIG. 1. The container 20 moves forward and backward with respect to the body 10 along with a movement of the door 13 while the drawer 15 is movably independent of the movement of the door 13. For the user's convenience, the container 20 may be automatically elevated when the door 13 is fully open. In an embodiment, an elevating device 30 is provided to the refrigerator as shown in FIGS. 2 and 3. The elevating device is secured to a rear surface of the door 13 and the container 20 is seated on and supported by the elevating device 20.

FIG. 3 illustrates a mechanism of the elevating device 30 in detail. The detailed mechanism of the elevating device 30 will be described referring to FIG. 3. As shown in FIG. 3, the elevating device 30 includes a lifter 31 on which the container 20 is seated, a pair of elevating rails 32 secured to the door 13 for guiding an elevating movement of the lifter 31, and a driving unit for automatically elevating the lifter 31.

The lifter 31, for example, has an "L" shaped bent form. A vertical portion of the lifter 31 is coupled with the pair of elevating rails 32 vertically secured to the backside of the door 13 and a horizontal portion of the lifer 31 supports the container 20 seated thereon. The lifter 31 moves upward and downward along the elevating rails 32 by the driving unit when the door 13 is open.

The driving unit includes at least one arm 37 rotatable with respect to the door 13, a motor 34, a gear assembly 35 coupled with a shaft of the motor 34, a driving shaft 36 coupled with the gear assembly 35 and the arm 37 to rotate the arm 37. In the illustrate embodiment, there two arms 37 arranged at both sides of a lower portion of the backside of the door 13. The motor 33 is secured to the rear of the door 13 and arranged between the two arms 37. The motor 34 is controlled by a controller (not shown) of the refrigerator or by a sub controller (not shown) for operating the motor 34 independent of the controller.

A roller 37*a* is provided at an end of the arm 37 to support a bottom surface of the lifter 31. The roller 37*a* rolls forward and backward on the bottom surface of the lifter 31 when the arm 37 is rotated by the motor 34. A slant projection 31*a* is provided on the bottom of the lifter 31 as shown in FIG. 3 and the roller 37*a* rolls over the projection 31*a* when the lifter 31 is fully elevated. Therefore, it can prevent the lifter 31, when fully elevated, from falling downward even if the motor 34 stops because the roller 37*a* is supported by the projection 31*a*.

There are an upper sensor 38*a* on top of the elevating rail 32 and a lower sensor 38*b* on bottom of the elevating rail 32. The upper sensor 38*a* and the lower sensor 38*b* detect the lifter 31 at the top or the bottom of the elevating rail 32, respectively, and send a signal to the controller. After receiving the signal, the controller stops the motor 34. Therefore, a movement range of the lifter 31 is limited and it would prevent the lifter 31 from being derailed from the elevating rail 32. Alternatively, there may be an upper limit switch (not shown) on the top of the elevating rail 32 and a lower limit switch (not shown) on the bottom of the elevating rail 32. The upper limit switch and the lower limit switch can directly stop the motor 34 by cutting off the power supplied to the motor 34.

In an embodiment, the lifter 31 is automatically elevated as soon as the door 13 is fully open or after the door 13 is fully open for a predetermined time passes, and the fully lifted lifter 31 automatically moves downward as soon as the door 13 is slightly pushed to be closed. Alternatively, a control button (not shown) may be provided on the doors 12 or 13 in order that the user can control the elevating device 30 by pushing the control button.

When the control button is pushed or a predetermined time passes after the door 13 is fully open, the motor 34 starts to work. Then, the gear assembly 35 runs by the motor 34 to rotate the driving shaft 36. As the driving shaft 36 is rotated, the arm 37 is getting rotated and the roller 37*a* at the end of the arm 37 is getting raised while rolling on the bottom of the lifter 37. Therefore, the lifter 31 is also getting raised along with the container 20 which is seated on the lifter 31. When the lifter 31 is fully lifted, the upper sensor 38*a* detects the lifter 31 and sends a signal to the controller. After receiving the signal, the controller stops the motor 34 and therefore stops an elevating movement of the lifter 31. At this time, the roller 37*a* at the end of the arm 37 is engaged with and supported by one side of the slant projection 31*a*. Therefore, the reverse movement of the arm 37 and the downward movement of the lifter 31 along with the container 20 due to the gravity can be effectively prevented.

Meanwhile, after taking the food out of the container 20 or putting new food into the container 20, the user pushes the control button or slightly pushes the door 13 towards the body 10 of the refrigerator. Then, the motor 34 reversely rotates its shaft. Therefore, the lifter 31 and the container 20 move downward together. In case that the lifter 31 and the container 20 fully come down, the lower sensor 38*b* and the controller stop a downward movement of the lifter 31. Then, the user can put the container 20 into the freezing compartment 11 by pushing the door 13 toward the body 10.

As mentioned above, the elevating device 30 movable with respect to the body 10 of the refrigerator along with the door 13 is supplied power from a power source 16 (shown in FIG. 2) in the body 10 of the refrigerator. Alternatively, it is possible that the other electrical devices, such as a display panel or a touch panel, etc., provided on the door 13 may need the electrical power. Further, it is also possible that another electrical device, such as a sensor, etc., communicating with the controller to send a signal, may be provided on the door 13. In these cases, it is necessary that the electrical devices movable with respect to the body 10 be connected with at least one of the power source 16 and the controller in the body 10 by a conductor such as a power cable or a signal cable.

An embodiment of the present invention provides a conductor 100 to electrically connect the electrical device movable with respect to the body 10 with the power source 16 or the controller in the body 10. The conductor 100 includes at least one of the power cable and the signal cable. A length of the conductor 100 in the first direction is adjusted by a winding device when the electrical device moves along the first direction. In other words, the winding device according to an embodiment of the present invention automatically shortens the length of the conductor when the door 13 is closed and lengthens the length of the conductor when the door 13 is open. In the illustrated embodiments, the first direction is the horizontal direction. However, it should be noted that the present invention can apply to any direction along which the electrical device or the door moves.

The winding device adjusts the length of the conductor 100 in the first direction by winding or unwinding the conductor 100 when the electrical device or the door 13 moves along the first direction. In addition, the winding device applies a tension of the conductor 100 in the first direction. Thereby, it can significantly reduce the slack of the conductor 100 and the risk of damage by other parts of the refrigerator according to an embodiment of the present invention.

The present invention presents various embodiments of the winding device as shown in FIGS. 2, and 4 to 11. As shown in the drawings, all embodiments of the present invention commonly present a reel to wind or unwind the conductor 100 when the electrical device moves along the first direction. However, a mechanism for automatically rotating the reel when the electrical device or the door moves along the first direction in each embodiment is different in every embodiment.

A winding device 200*a* in accordance with a first embodiment of the present invention is illustrated in FIGS. 2, and 4 to 7 and a winding device 200*b* in accordance with a second embodiment of the present invention is illustrated in FIGS. 8 to 11. All embodiments of the winding device according to the present invention and their variations will now be described step by step referring to the above mentioned drawings corresponding to each embodiment.

Figure 4:
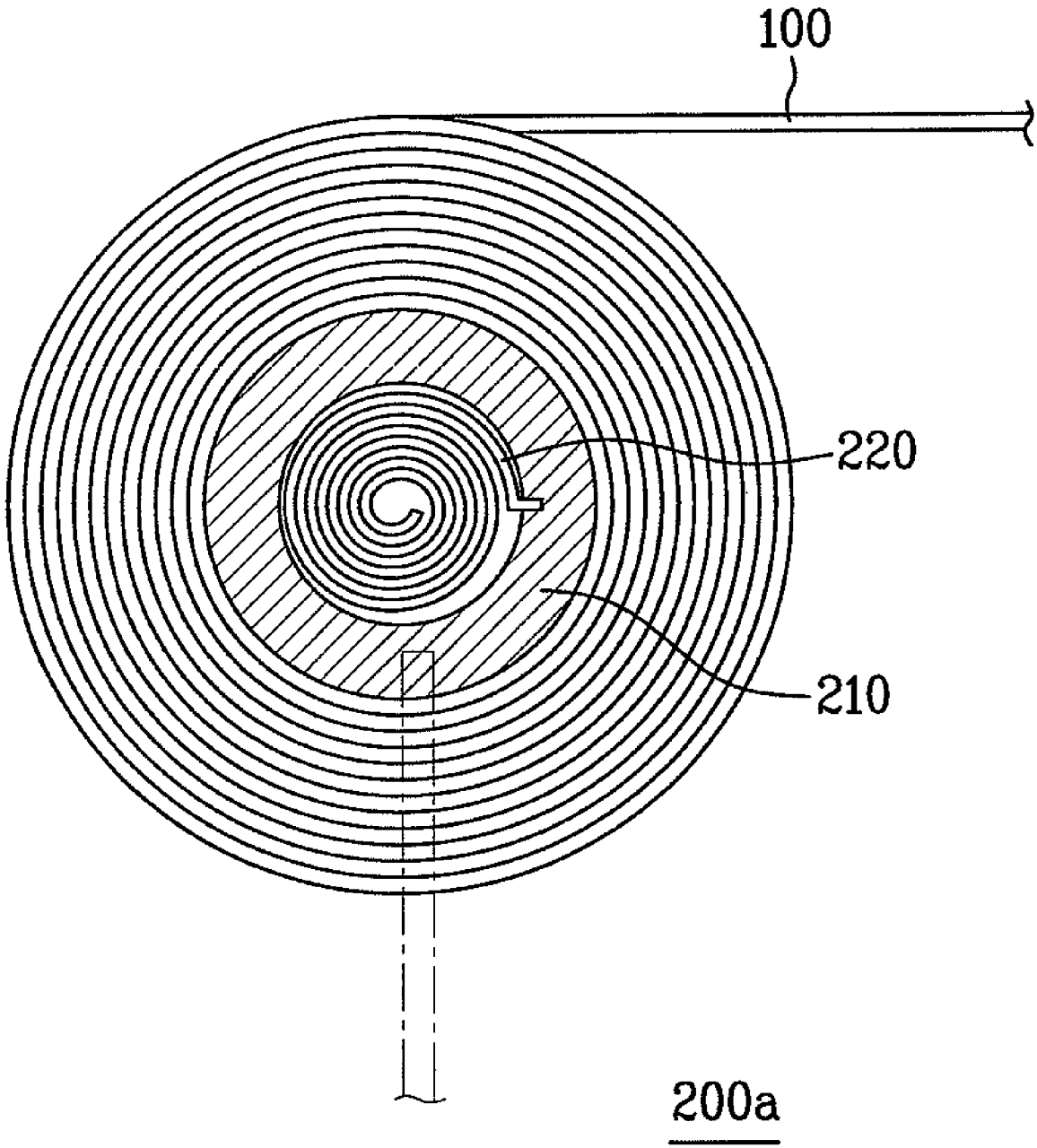
FIG. 4 illustrates diagrams of a winding device according to a first embodiment of the present invention.

Referring to FIGS. 2, and 4 to 7, the winding device 200*a* according to the first embodiment of the present invention includes a reel 210 around which the conductor 100 is wound, and an elastic member 220 providing the reel 210 with a rotating force by an elastic force. The reel 210, for example, has a cylindrical shape and the conductor 100 is wound around an outer circumferential surface of the cylindrical reel 210 while the reel 210 rotates. The reel 210, for example, has a space therein, and the elastic member 220 is disposed in the space as shown in FIG. 4. The elastic member 220 may include a wind-up spring which accumulates the elastic energy therein while being wound or unwound according to the rotating movement of the reel 210.

A first end of the elastic member 220 may be connected to the reel 210 and a second end of the elastic member 220 may be connected to the body 10 and vice versa. Alternatively, the first end of the elastic member 220 may be connected to the reel 210 and the second end of the elastic member 220 may be connected to other part separated from the reel 220, for example, the rail 40 and vice versa. In addition, it is possible that a housing (not shown) encompassing the reel 210 and a part of the conductor 100 wound around the reel 210 is provided in the refrigerator, and the elastic member 220 is connected to the reel 210 and the housing.

The conductor 100 is wound around the reel 210 in a plurality of turns when the door 13 is closed because a distance between the electrical device, i.e., the elevating device 30, and the power source 16 or the controller in the body 10 is closer as shown in FIG. 5. In addition, the length of the conductor 100 in the horizontal direction, except some part which is wound around the reel 210, is shortened, so as to significantly reduce the slack of the conductor 100. At this time, the elastic member 220 in the illustrated embodiment keeps applying a weak elastic force to the reel 210 to rotate the reel 210 in the counterclockwise direction. The reel 210, however, is not rotated by the elastic force because the conductor 100 is fully stretched. Therefore, the elastic member 220 keeps tightening the conductor 100 and applying a tension on the conductor 100 in the horizontal direction toward the compartment when the door 13 is closed; thereby the slack of the conductor 100 is effectively reduced.

The conductor 100 wound around the reel 210 is getting unwound when the door is getting open away from the body 10. At this time, the length of the conductor 100 in the horizontal direction, except some wound part, is getting lengthened while the reel 210 rotates in the clockwise direction, and the elastic member 220 accumulates the elastic force therein while the reel 210 rotates in the clockwise direction. When the door 13 is fully open, the length of the conductor 100 in the horizontal direction is maximized and the elastic energy and force of the elastic member 220 is also maximized. At this time, since the elastic member 220 keeps applying the elastic force to the reel 210 to rotate the reel 100 in the counterclockwise direction, the conductor 100 is tightened and the tension thereof is also applied. Therefore, it can significantly reduce the slack of the conductor 100 although the conductor 100 is fully lengthened.

On the contrary, when the door 13 is getting closed, a force pulling the conductor 100 in the horizontal direction away from the body is getting removed. Therefore, the reel 210 rotates in the counterclockwise direction and the conductor 100 is getting wound around the reel 210 because the elastic member 220 keeps rotating the reel 210 in the counterclockwise direction with a strong elastic force. Since the reel 210 rotated by the elastic member 220 tightly pulls the conductor 100 while the door 13 is getting closed, the conductor 100 is tightened and the tension of the conductor 100 is applied. Therefore, it can significantly reduce the slack of the conductor 100 while the door 13 is getting closed.

Figure 6:
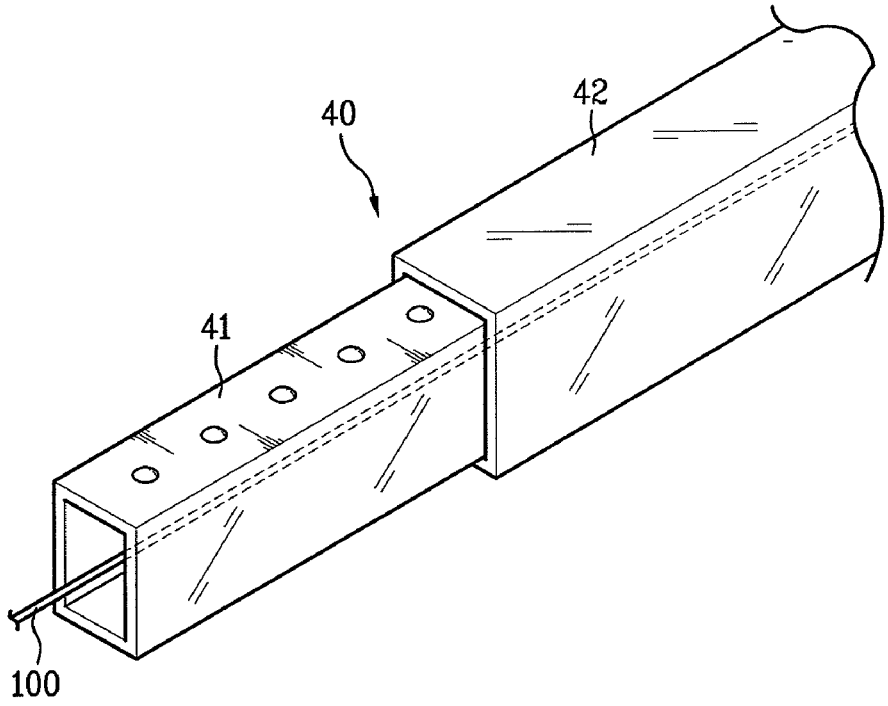
FIG. 6 illustrates a partial perspective view of rails shown in FIG. 2.

It is all right that the conductor 100 is exposed. However, to further protect the conductor 100, it is preferred that the conductor 100 is encompassed by other parts of the refrigerator. In an embodiment, the conductor 100 is arranged to pass through the rails 40 guiding the movement of the door 13; thereby the conductor 100 is encompassed and securely protected. More particularly, the first and the second rails 41 and 42 have a hollow pillar shape, respectively. The first rail 41 is insertable into the second rail 42 along a longitudinal direction of the second rail 42 and vice versa. The conductor 100 is arranged to pass through the first and the second rails 41 and 42 at the same time as shown in FIG. 6.

Figure 7:
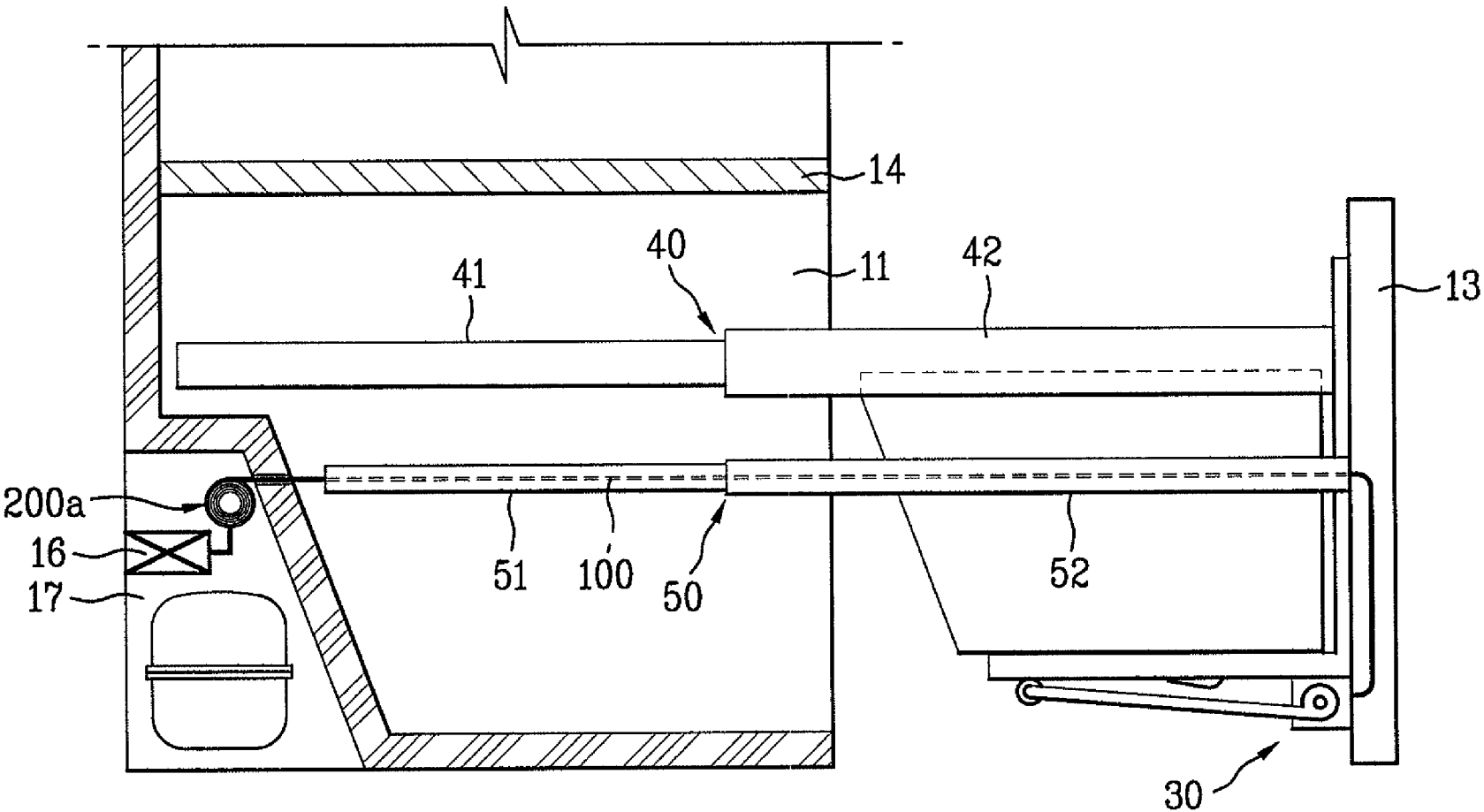
FIG. 7 illustrates a schematic cross-sectional view of the lower portion of the refrigerator in accordance with a variation of the first embodiment of the present invention.

Alternatively, it is possible that a conductor guide 50, independent of the rails 41 and 42, is provided to the refrigerator according to the first embodiment and the conductor 100 is arranged to pass through the conductor guide 50, as shown in FIG. 7. The conductor guide 50 is extendable and retractable along a longitudinal direction thereof according to the movement of the electrical device, i.e., the elevating device 30 or the door 13.

More particularly, the conductor guide 50 includes a first guide 51 secured to the body 10 of the refrigerator and a second guide 52 secured to the door 13 directly or secured to a supporter firmly secured to the door 13. The first guide 51 may be overlapped with the second guide 52 when the door 13 is closed by being inserted into the second guide 52 along a longitudinal direction of the second guide 52 and vice versa. Therefore, the conductor guide 50 is extendable and retractable along a longitudinal direction thereof by a relative movement of the first and the second guides 51 and 52 according to the movement of the electrical device or the door 13. These mechanisms are very similar to those of the first and the second rails 41 and 42; therefore more detailed descriptions about the structure of the conductor guide 50 will be omitted.

In the embodiment shown in FIG. 7, the movement of the door 13 forward and backward with respect to the body 10 in order to open and close the freezing compartment 11 is smoothly guided by the first and the second rails 41 and 42, and the conductor 100 is stably protected by the first and the second guides 51 and 52. Meanwhile, although it is not shown in the drawings, the conductor guide 50 may include three or more than three guides connected with each other.

Meanwhile, in the first embodiment, the winding device 200*a* may be provided in the freezing compartment 11 as shown in FIGS. 2 and 5. Alternatively, the winding device 200*a* according to the first embodiment of the present invention may be provided in the mechanical component chamber 17 as shown in FIG. 7. However, the present invention is not limited to the above examples. For examples, the winding device 200*a* may be provided in the rail 40 or the conductor guide 50 as depicted in FIG. 2 and FIG. 5.

As mentioned above, the winding device 200*a* according to the first embodiment of the present invention automatically adjusts the length of the conductor 100 in the horizontal direction, except some wound part, according to the movement of the electrical device or the door 13. In addition, the winding device 200*a* always tightens the conductor 100 and applies the tension on the conductor 100 regardless of the location of the electrical device or the door 13. Therefore, it can effectively reduce the slack of the conductor 100 and the risk of damage by other part of the refrigerator.

Meanwhile, referring to FIGS. 8 to 11, the winding device 200*b* in accordance with the second embodiment of the present invention includes a reel 260 and a mechanism for rotating the reel 260. The mechanism rotates the reel 260 clockwise or counterclockwise according to the movement of the electrical device or the door 13 so that the conductor 100 is wound around or unwound from an outer circumferential surface of the reel 260 when the electrical device or the door 13 moves.

The conductor 100 may be unwound from the reel 260 while the reel 260 rotates in the clockwise direction by the mechanism in the illustrated embodiment when the electrical device or the door 13 moves forward with respect to the body 10. On the contrary, the conductor 100 may be wound around the reel 260 while the reel 260 rotates in the counterclockwise direction by the mechanism when the electrical device or the door 13 moves backward with respect to the body 10. The detailed structure of the reel 260 and the mechanism now will be described referring to the above drawings as follows.

Figure 9:
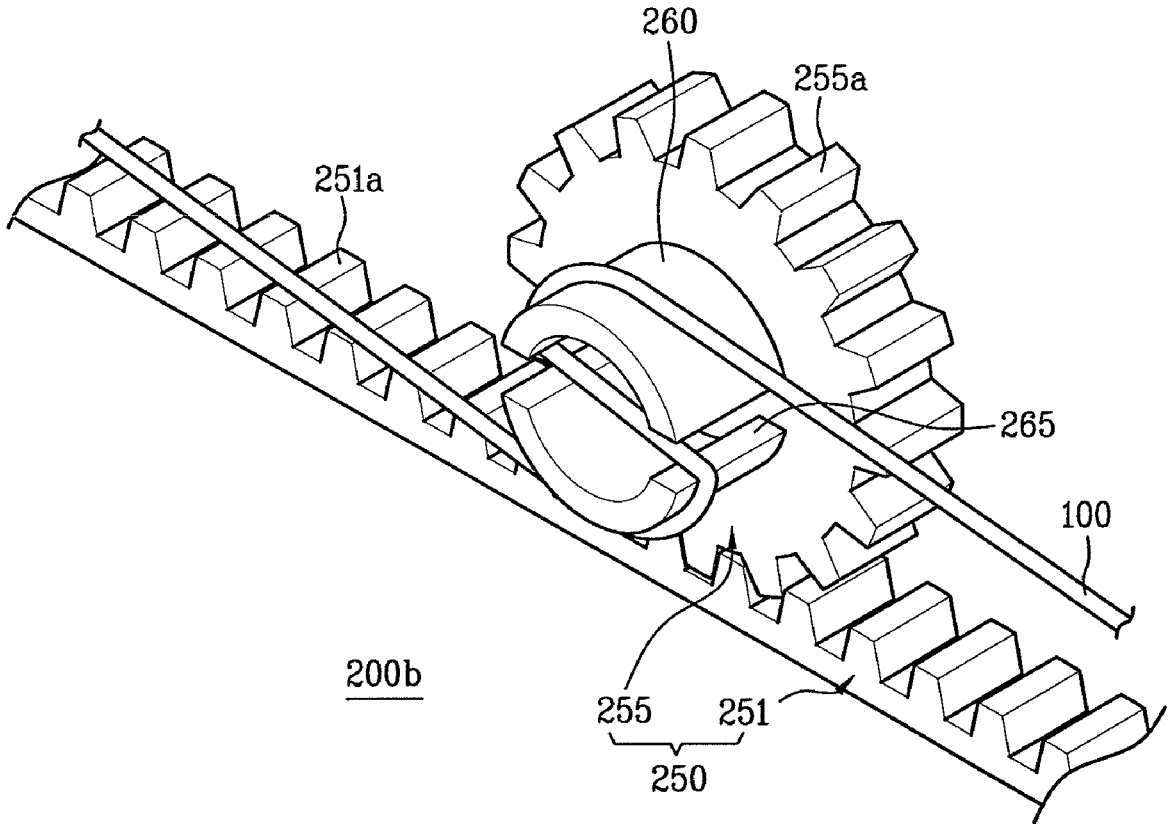
FIG. 9 illustrates a partial perspective view of a winding device according to the second embodiment of the present invention.

The reel 260 has, for example, a hollow cylindrical shape as shown in FIG. 9 and the conductor 100 is arranged to pass through the reel 260. An aperture 265 is provided at the reel 260. The aperture 265 penetrates the cylindrical reel 260 along a diametrical direction of the reel 260 and the conductor 100 passes through the aperture 265. The aperture 265 may have a circular shape (not shown in the drawings) or an elongated slot shape as shown in FIG. 9. In the illustrated embodiment, the reel 260 has two slots at the circumference of the reel and the conductor passes through two slots along the diametrical direction of the reel 260 to be wound around the circumference of reel when the reel rotates.

Figure 8:
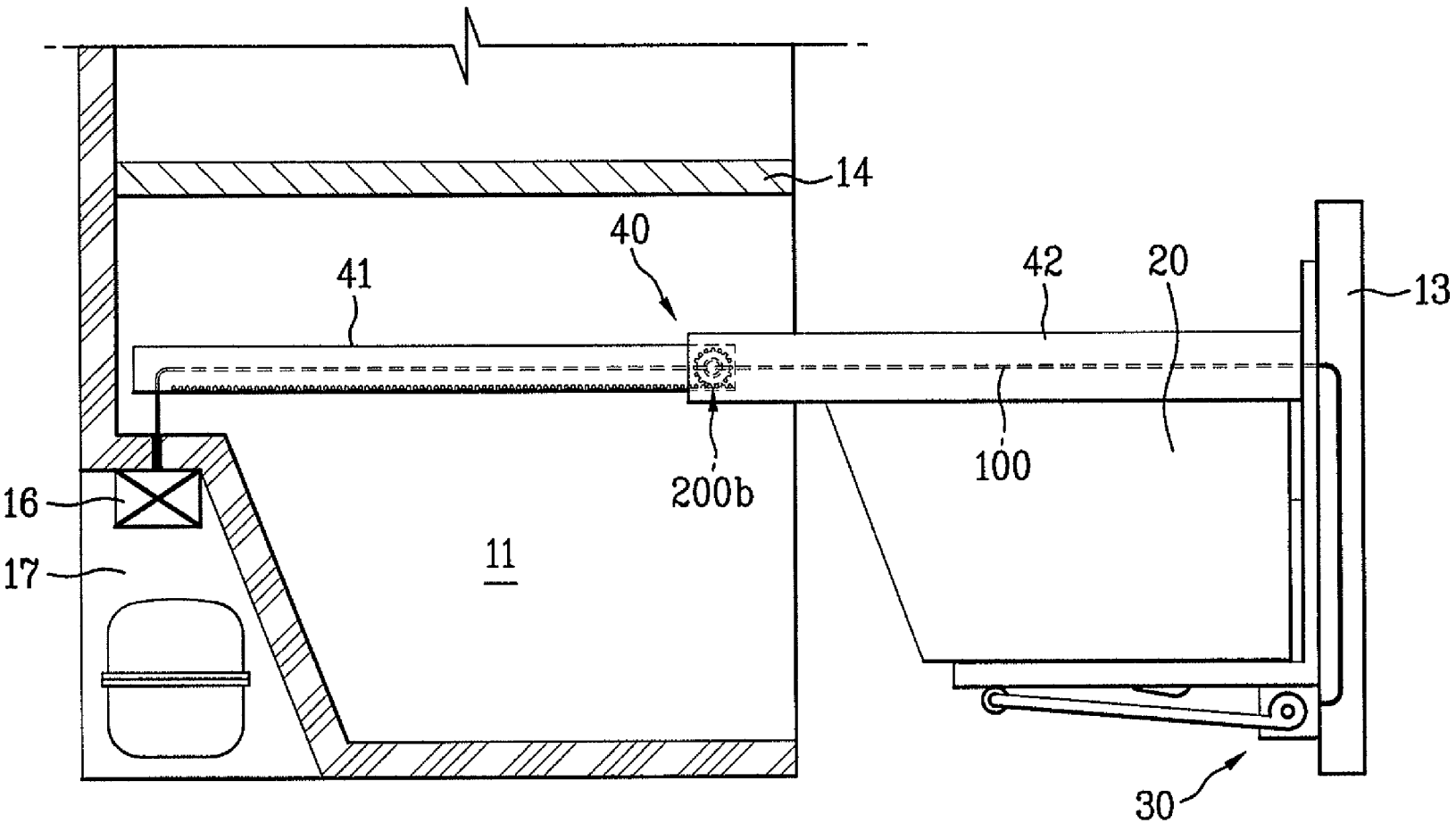
FIG. 8 illustrates a schematic cross-sectional view of the lower portion of the refrigerator in accordance with a second embodiment of the present invention when the door is open.

The reel 260 may be located at a middle portion of the conductor 100 as shown in FIG. 8. In this case, the conductor 100 at its both sides is wound around the reel 260 at the same time when the reel 260 rotates. Then, the conductor 100 is wound around the reel 260 in a turn when the reel 260 rotates in a half turn.

The mechanism may include a rack 251, and pinion 255 coupled with the reel 260 and engaged with the rack 251 as shown in FIG. 9. The rack 251 is arranged along a direction in which the electrical device and the door 13 move. A plurality of teeth 251*a* are provided on one side of the rack 251 along a longitudinal direction of the rack 251 and the pinion 255 has a plurality of teeth 255*a* which are engaged with the teeth 251*a* as shown in FIG. 9. Therefore, the pinion 255 rotates when the rack 251 moves along a longitudinal direction of the rack 251.

The reel 260 is, for example, extended from a lateral side of the pinion 255 as shown in FIG. 9 so that the reel 260 and the pinion 255 rotate together. The pinion 255 and the reel 260 may be formed as a unitary body. In this case, the pinion 255 and the reel 260 may be manufactured by molding. Alternatively, the pinion 255 and the reel 260 may be formed of two separated units and then are assembled together. Meanwhile, it is preferred, but not necessary, that a center of the pinion 255 is arranged at a center of the reel 260.

The rack 251 may be firmly coupled to the body 100 and the pinion 255 may be rotatably coupled to the door 13. The pinion 255 is movable with respect to the body 10 along with the door 13, while the rack 251 is not movable with respect to the body 10. The rack 251 and the pinion 255 may be arranged at both sides of the container 20 in order not to interfere with the movement of the door 13 or an action of the user. On the contrary to the above, the rack 251 may be coupled to the door 13 and the pinion 255 may be rotatably coupled to the body 10.

Figure 10:
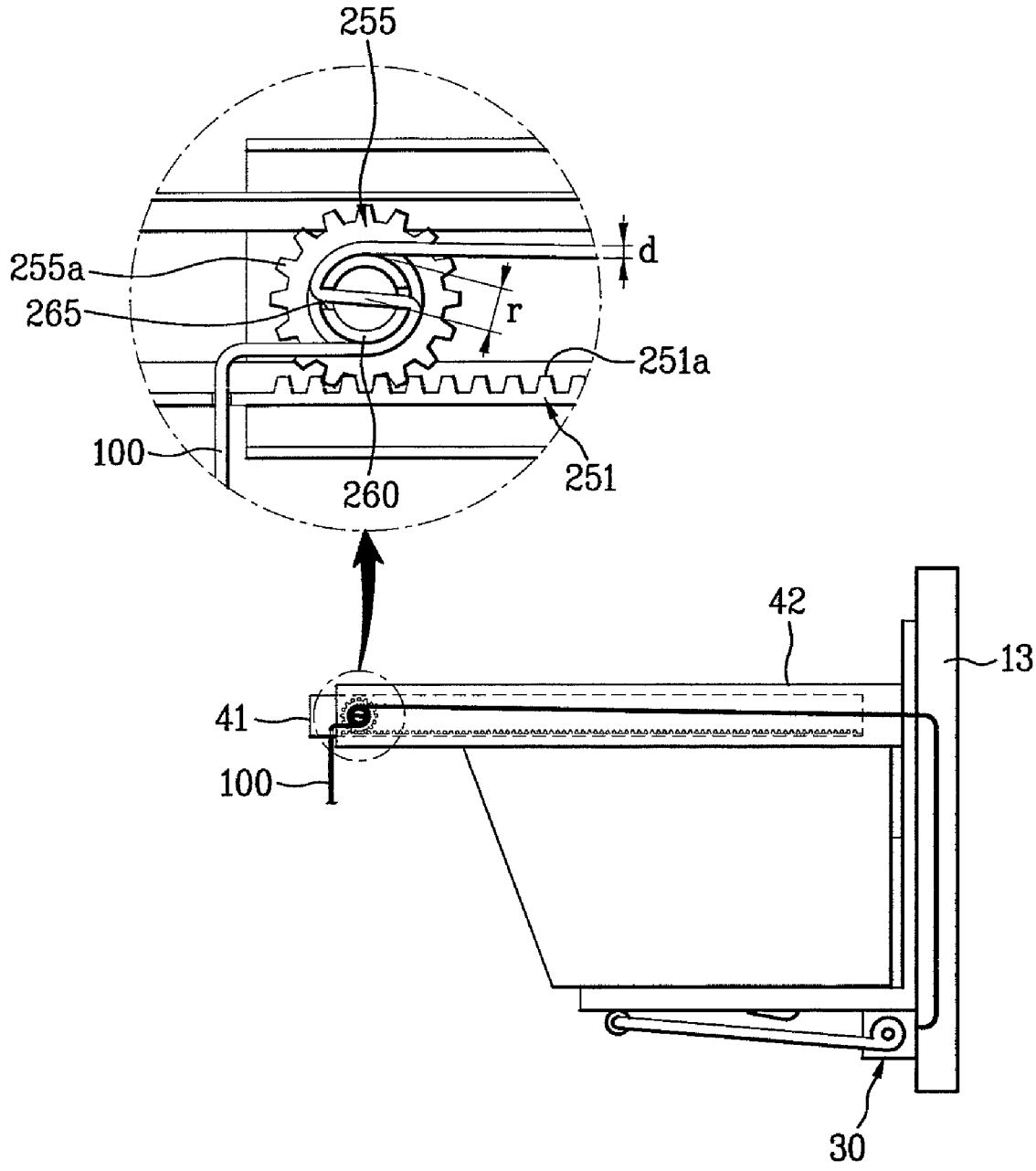
FIG. 10 illustrates a schematic cross-sectional view of the lower portion of the refrigerator in accordance with the second embodiment of the present invention when the door is closed.

In operation of the winding device 200*b* in accordance with the second embodiment of the present invention, the conductor 100 is wound around the reel 260 in a plurality of turns when the door 13 is closed as shown in FIG. 10. At this time, the distance between the electrical device, i.e., the elevating device 30 and the power source 16 or the controller in the body 10 is minimized and the length of the conductor 100 in the horizontal direction, except some wound part, is minimized. In addition, since the conductor 100 is fully wound around the reel 260, the conductor 100 is not slack.

The pinion 255 is moving forward with respect to the body 10 along with the door 13, when the door 13 is getting open. At this time, the pinion 255 and the reel 260 are rotating together in the clockwise direction; thereby the conductor 100 wound around the reel 260 is getting unwound from the reel 260 and the length of the conductor 100 in the horizontal direction, except some wound part, is getting lengthened. When the door 13 is fully open, the conductor 100 is fully or almost unwound from the reel 260; thereby the length of the conductor 100 in the horizontal direction is maximized as shown in FIG. 8. In addition, the slack of the conductor 100 can be significantly reduced although the door 13 is fully open because the middle portion of the conductor 100 is wound around or hung to the reel 260. Preferably, but not necessarily, the unwound conductor 100 is stretched in a straight line when the door 13 is fully open not to be slack.

After taking or putting food from or into the freezing compartment 11, the door 13 is closed. Then, the pinion 255 moves backward with respect to the body 10 along with the door 13. At this time, the pinion 255 and the reel 260 rotate in the counterclockwise direction. Accordingly, the conductor 100 unwound from the reel 260 is getting wound around the reel 260 and the length of the conductor 100 in the horizontal direction, except some wound part, is getting shortened. When the door 13 is fully closed, the conductor 100 is wound around the reel 260 in the plurality of turns; thereby significantly reducing the slack of the conductor 100.

Alternatively, in case that the rack 251 is coupled to the door 13 and the pinion 255 is coupled to the body 10, the rack 251 moves forward and backward with respect to the body 10 according to the movement of the door 13. In this case, the pinion 255 and the reel 260 just rotate at a settled position in the body 10 and wind or unwind the conductor 100.

Meanwhile, the winding device 200*b* may be provided in the rails 41 and 42 in case that the conductor 100 is arranged to pass through the rails 41 and 42 as mentioned above. In this case, for example, the rack 251 is arranged in the first rail 41 along a longitudinal direction of the rail 41 and the pinion 255 is located in the second rail 42 as shown in FIG. 8. More particularly, the rack 251 is provided throughout from a first end of the first rail 41 to a second end of the first rail 41 opposite to the first end and the pinion 255 is coupled at a first end of the second rail 42 in which the first rail 41 is inserted. Alternatively, the rack 251 may be arranged in the second rail 42 and the pinion 255 may be located in the second end of the first rail 41.

Figure 11:
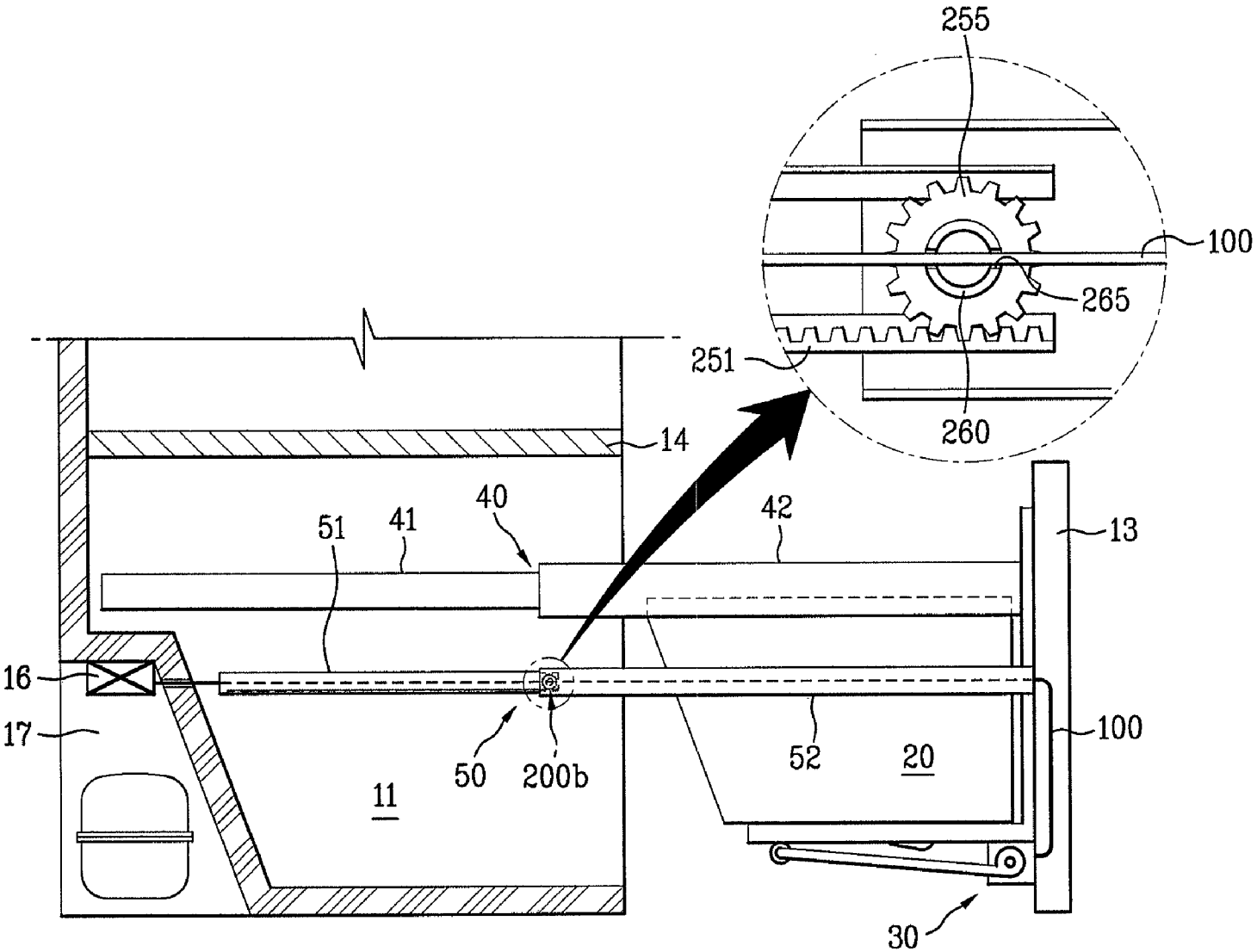
FIG. 11 illustrates a schematic cross-sectional view of the lower portion of the refrigerator in accordance with a variation of the second embodiment of the present invention.

Alternatively, the winding device 200*b* may be provided in the conductor guide 50 independent of the rails 41 and 42 in case that the conductor guide 50 is provided in the refrigerator and the conductor 100 is arranged to pass through the conductor guide 50 as shown in FIG. 11. In this case, the rack 251 may be arranged in the first guide 51 and the pinion 255 may be provided in the second guide 52 and vice versa.

In case that the winding device 200*b* is provided in the rail 40 or the conductor guide 50, device 200*b* and the conductor 100 is safely secured by the rail 40 or the conductor 50. Therefore, the winding device 200*b* and the conductor 100 are prevented from being damaged by other parts of the refrigerator or by the user.

As mentioned above, the winding device 200*b* automatically adjusts the length of the conductor 100 in the horizontal direction according to the movement of the electrical device or the door 13 by winding or unwinding the conductor 10 when the electrical device or the door 13 moves. Therefore, it can effectively reduce the slack of the conductor 100 and the risk of damage by the other parts of the refrigerator.

Meanwhile, as described before, the refrigerator according to the first and second embodiments of the present invention has the following advantages.

The refrigerator provides the elevating device which enables the container in the compartment at the lower portion of the refrigerator to be elevated when the door is open. Therefore, it is not necessary that the user kneels down and bends over his or her body to take food from or put food into the container. Accordingly, the refrigerator is very easy and convenient to be used.

In addition to this, the present invention provides the winding device for automatically adjusting a length of the conductor in the first direction when the electrical device or the door moves along the first direction. Therefore, the present invention enables the conductor to electrically connect the body of the refrigerator with the electrical device or the door although the electrical device or the door is movable forward and backward with respect to the body.

Further, the winding device applies a tension on the conductor in the first direction toward the compartment. In addition, the winding device automatically winds or unwinds the conductor according to the movement of the electrical device or the door. Therefore, it can significantly reduce the slack of the conductor when the door is fully open. Therefore, the conductor is prevented from being damaged by other parts of the refrigerator.

Finally, the conductor and the winding device may be encompassed by the rails for guiding the movement of the door or by the conductor guide. Therefore, the conductor and the winding device are protected with safety, and the user is protected from receiving an electric shock. In addition, the winding device services to change the direction of the conductor from a horizontal orientation to a vertical orientation.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a body having a compartment in the body;

a door for opening and closing the compartment;

a container provided in the compartment;

a first rail secured to the body;

a second rail secured to the door, the first and second rails being telescopic rails, supporting the door and guiding movement of the door along a first direction;

an elevating device movable with respect to the body along the first direction and mounted on the door for elevating the container;

a conductor electrically connecting the elevating device with the body to supply power or a signal to the elevating device, the conductor extending through the first rail and the second rail; and a winding device configured to apply a tension to the conductor in the first direction toward the compartment to reduce slack in the conductor when the door is open, the winding device being within the first rail;

wherein the winding device includes a reel around which the conductor is wound; and an elastic member configured to apply a rotational force on the reel so that the tension is applied to the conductor in the first direction toward the compartment to tighten the conductor.

2. The refrigerator of claim 1, wherein the elastic member includes a spring which accumulates an elastic energy therein while the door is open.

3. The refrigerator of claim 1, wherein the first direction is a horizontal direction.

4. The refrigerator of claim 1, wherein the winding device is inside the compartment.

5. The refrigerator of claim 1, wherein the elevating device includes:

a lifter on which the container is seated;

a pair of elevating rails secured to the door for guiding an elevating movement of the lifter; and a driving unit for automatically elevating the lifter.

6. The refrigerator of claim 5, wherein the driving unit includes:

at least one arm rotatable with respect to the door;

a motor;

a gear assembly coupled with a shaft of the motor; and a driving shaft coupled with the gear assembly and the arm to rotate the arm.

7. The refrigerator of claim 1, wherein the winding device changes the conductor from a horizontal orientation to a vertical orientation.

8. A refrigerator comprising:

a body having a compartment in the body and a door for opening and closing the compartment;

a container provided in the compartment;

an elevating device movable with respect to the body along a first direction and mounted on the door for elevating the container;

a conductor for electrically connecting the elevating device with the body to supply power or a signal to the elevating device;

a conductor guide extendable and retractable along the first direction when the elevating device moves along the first direction, wherein the conductor passes through the conductor guide; and a winding device configured to apply a tension to the conductor in the first direction toward the compartment, the winding device comprising:

a reel around which the conductor is wound; and an elastic member configured to apply a rotational force on the reel so that the tension is applied to the conductor in the first direction toward the compartment to reduce slack in the conductor when the door is open, the winding device being within the conductor guide.

9. The refrigerator of claim 8, wherein the conductor guide includes a first guide and a second guide overlappable with each other along the first direction.

10. The refrigerator of claim 8, wherein the conductor is unwound or wound on the reel when the elevating device moves along the first direction to adjust a length of the conductor in the first direction.

11. The refrigerator of claim 8, wherein the elastic member includes a spring which accumulates an elastic energy therein while the door is open.

12. The refrigerator of claim 8, further comprising:

a first rail secured to the body;

a second rail secured to the door, the first and second rails guiding a movement of the door along the first direction.

13. The refrigerator of claim 12, wherein the conductor guide is parallel to the first rail and the second rail.

14. The refrigerator of claim 8, wherein the conductor guide includes a first guide and a second guide telescoping in the first guide along the first direction.

15. The refrigerator of claim 8, wherein the winding device changes the conductor from a horizontal orientation to a vertical orientation.

* * * * *